US009599424B2

(12) United States Patent
Derus

(10) Patent No.: US 9,599,424 B2
(45) Date of Patent: Mar. 21, 2017

(54) BOW RISER

(71) Applicant: Perfect Form Manufacturing LLC, West Henrietta, NY (US)

(72) Inventor: Michael W. Derus, Victor, NY (US)

(73) Assignee: Perfect Form Manufacturing LLC, West Henrietta, NY (US)

( * ) Notice: Subject to any disclaimer, the term of this patent is extended or adjusted under 35 U.S.C. 154(b) by 0 days.

(21) Appl. No.: 15/163,291

(22) Filed: May 24, 2016

(65) Prior Publication Data

US 2016/0265865 A1 Sep. 15, 2016

Related U.S. Application Data

(63) Continuation of application No. 14/492,396, filed on Sep. 22, 2014, now Pat. No. 9,377,266.

(60) Provisional application No. 61/880,303, filed on Sep. 20, 2013.

(51) Int. Cl.
*F41B 5/00* (2006.01)
*F41B 5/14* (2006.01)
*F41B 5/10* (2006.01)

(52) U.S. Cl.
CPC ..... *F41B 5/0031* (2013.01); *F41B 5/0078* (2013.01); *F41B 5/10* (2013.01); *F41B 5/14* (2013.01); *F41B 5/143* (2013.01)

(58) Field of Classification Search
CPC ..... F41B 5/00; F41B 5/10; F41B 5/14; F41B 5/0031
USPC ..... 124/23.1, 25.6, 86, 88
See application file for complete search history.

(56) References Cited

U.S. PATENT DOCUMENTS 1,689,141 A * 10/1928 Keller ..... F41B 5/0094 124/22
1,847,593 A * 3/1932 Cameron ..... F41G 1/467 124/24.1
2,186,386 A * 1/1940 Lowell ..... F41B 5/143 124/24.1
2,909,167 A * 10/1959 Fredrickson ..... F41B 5/14 124/24.1
3,055,353 A * 9/1962 Perrucci ..... F41B 5/0005 124/24.1
3,923,036 A 12/1975 Jennings et al.
4,257,385 A 3/1981 Stewart
4,343,286 A 8/1982 Thacker
4,458,657 A 7/1984 Stockmar
4,759,337 A * 7/1988 Suski ..... F41B 5/14 124/24.1
4,971,020 A * 11/1990 Soderstrom ..... F41B 5/10 124/23.1
5,099,819 A * 3/1992 Simonds ..... F41B 5/10 124/23.1
5,649,519 A * 7/1997 Linderman ..... F41B 5/0005 124/23.1
5,682,871 A * 11/1997 Walk ..... F41B 5/10 124/24.1
6,019,097 A 2/2000 Cox et al.
6,142,133 A * 11/2000 Anderson ..... F41B 5/10 124/24.1

(Continued)

*Primary Examiner* — Alexander Niconovich
(74) *Attorney, Agent, or Firm* — Barclay Damon, LLP

(57) ABSTRACT

A riser for a bow is disclosed. The riser, in an embodiment, includes an upper section, a structure, a middle section, and a lower section. The structure defines a cavity, and the structure is configured to reduce deformation of at least part of the riser.

21 Claims, 8 Drawing Sheets

(56) References Cited

U.S. PATENT DOCUMENTS

| | | | | |
|---|---|---|---|---|
| 6,758,204 | B1 * | 7/2004 | Goff | F41B 5/10 124/25.6 |
| 7,066,165 | B2 * | 6/2006 | Perry | F41B 5/0005 124/23.1 |
| 7,258,113 | B2 | 8/2007 | Pilpel et al. | |
| 7,373,934 | B2 * | 5/2008 | Smith | F41B 5/10 124/25.6 |
| 8,079,353 | B2 * | 12/2011 | Davis | F41B 5/0026 124/23.1 |
| 8,522,762 | B2 | 9/2013 | Trpkovski | |
| 8,622,050 | B2 * | 1/2014 | Goff | F41B 5/12 124/25 |
| 8,627,810 | B2 * | 1/2014 | McPherson | F41B 5/10 124/23.1 |
| 8,807,125 | B1 * | 8/2014 | Mathur | B29C 45/0005 124/23.1 |
| 8,844,510 | B2 | 9/2014 | Liu | |
| 2007/0084451 | A1 * | 4/2007 | Perry | F41B 5/14 124/23.1 |
| 2007/0101980 | A1 * | 5/2007 | Sims | F41B 5/10 124/25.6 |
| 2010/0000504 | A1 * | 1/2010 | Trpkovski | F41B 5/0094 124/25.6 |
| 2014/0261354 | A1 * | 9/2014 | Ross, Jr. | F41B 5/143 124/23.1 |
| 2014/0366858 | A1 * | 12/2014 | Garver | F41B 5/1403 124/25.6 |
| 2015/0153131 | A1 * | 6/2015 | Trpkovski | F41B 5/1426 124/25.6 |
| 2016/0102937 | A1 * | 4/2016 | Ell | F41B 5/1403 124/25.6 |

* cited by examiner

BOW RISER

CROSS-REFERENCE TO RELATED APPLICATIONS

This application is a continuation of, and claims the benefit and priority of, U.S. patent application Ser. No. 14/492,396, filed on Sep. 22, 2014, which is a non-provisional of, and claims the benefit and priority of, U.S. Provisional Patent Application No. 61/880,303, filed on Sep. 20, 2013. The entire contents of such applications are hereby incorporated by reference.

BACKGROUND OF THE INVENTION

The subject matter disclosed herein relates to archery bows and more particularly to risers for bows. Archery risers are the central portion of a bow that provide a means for attachment of other bow components such as limbs, grips, sights, etc. During a bow's draw cycle, the riser is placed under extreme stress which often produces riser deformation. Excessive deformation of the riser can hinder repeatability, accuracy, promote riser fatigue, decrease safety and negatively impact other parameters of the bow. An improved archery riser is therefore desirable. The discussion above is merely provided for general background information and is not intended to be used as an aid in determining the scope of the claimed subject matter.

BRIEF DESCRIPTION OF THE INVENTION

A riser for a bow is disclosed. The riser includes a top riser section that is joined to a middle riser section by a first and second step. The first and second steps strengthen the riser and permit the riser to be formed from less material while resisting undesirable deformation during use. An advantage that may be realized in the practice of some disclosed embodiments of the ability to produce a riser for a bow that uses less material than other risers while maintaining a riser that resists undesirable deformation.

In a first embodiment, a riser for a bow is provided. The riser comprises a top riser section joined to a middle riser section. The top riser section defines a first plane and the middle riser section defines a second plane. The first plane and the second plane are spaced from one another by a gap to provide an arrow shelf. The top riser section is joined to the middle riser section by both a first top step and a second top step. The first top step and the second top step join together at a first junction, separate from one another to form a cavity, then reunite at a second junction. The first junction is in the first plane and connects to the top riser section and the second junction is in the second plane and connects to the middle riser section.

In a second embodiment, a riser for a bow is provided. The riser comprises a top riser section joined to a bottom riser section by a middle riser section. The top riser section and the bottom riser section are aligned to define a first plane and the middle riser section defines a second plane. The first plane and the second plane are spaced from one another by a gap to provide an arrow shelf. The bottom riser section is joined to the middle riser section by a bottom step and the top riser section is joined to the middle riser section by both a first top step and a second top step. The first top step and the second top step join together at a first junction, separate from one another to form a cavity, then reunite at a second junction. The first junction is in the first plane and connects to the top riser section. The second junction being in the second plane and connects to the middle riser section.

In a third embodiment, a bow is provided. The bow comprises a riser comprising a top riser section joined to a bottom riser section by a middle riser section. The top riser section and the bottom riser section are aligned to define a first plane and the middle riser section defines a second plane. The first plane and the second plane are spaced from one another by a gap to provide an arrow shelf. The bottom riser section is joined to the middle riser section by a bottom step and the top riser section is joined to the middle riser section by both a first top step and a second top step. The first top step and the second top step join together at a first junction, separate from one another to form a cavity, then reunite at a second junction. The first junction is in the first plane and connects to the top riser section and the second junction is in the second plane and connects to the middle riser section. The bow further comprises a first bow limb removably attached to the top riser section and a second bow limb removably attached to the bottom riser section.

This brief description of the invention is intended only to provide a brief overview of subject matter disclosed herein according to one or more illustrative embodiments, and does not serve as a guide to interpreting the claims or to define or limit the scope of the invention, which is defined only by the appended claims. This brief description is provided to introduce an illustrative selection of concepts in a simplified form that are further described below in the detailed description. This brief description is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which.

DETAILED DESCRIPTION OF THE INVENTION

Figure 1A:
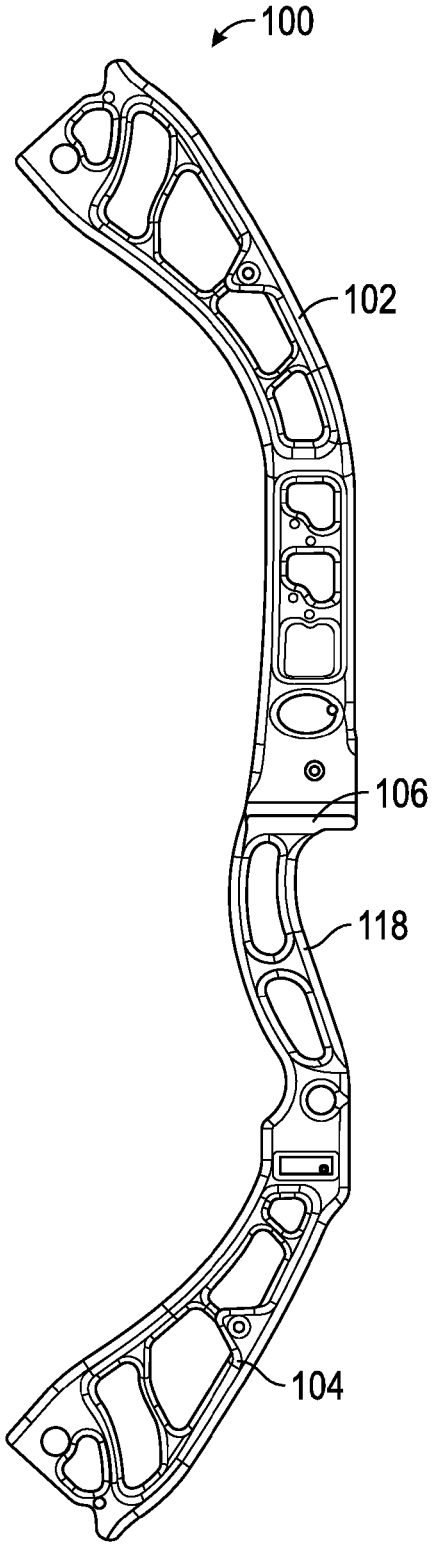
FIG. 1A, FIG. 1B and FIG. 1C are side, front and perspective views of an exemplary riser.
Figure 1B:
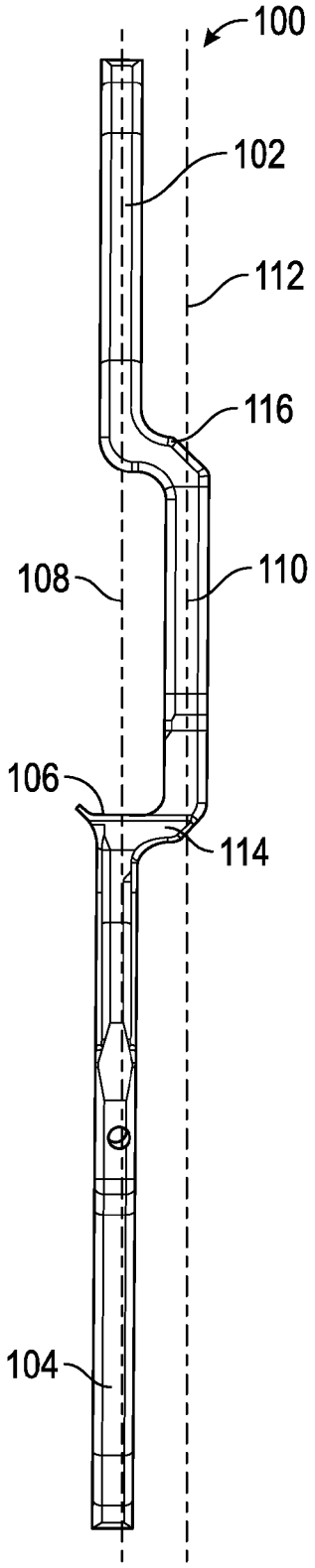
Figure 1C:
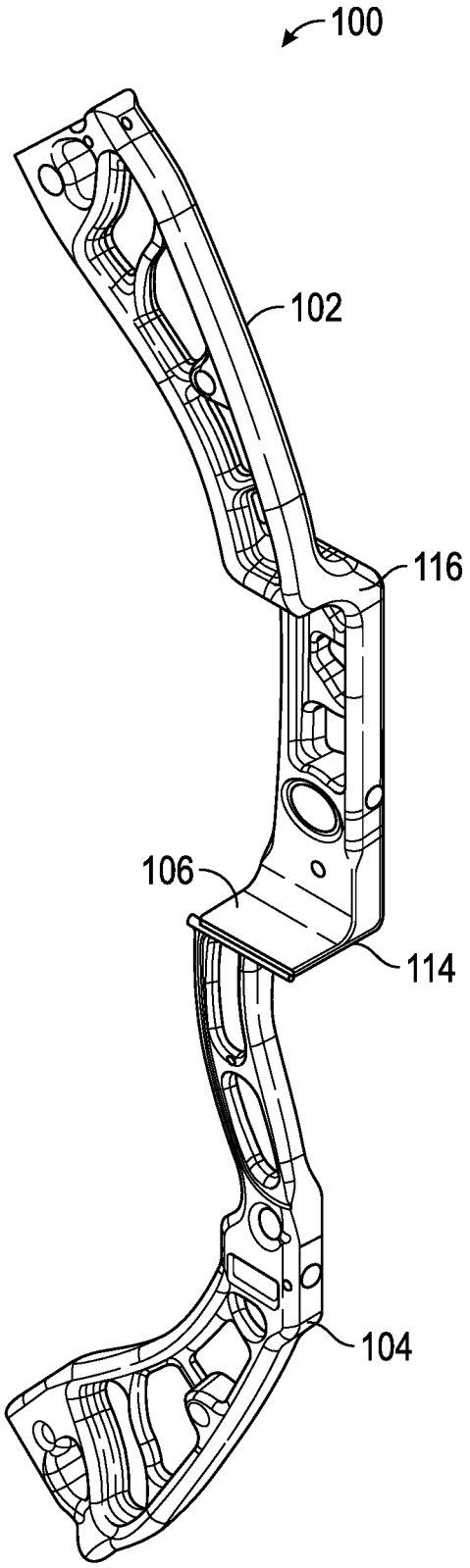

FIG. 1A, FIG. 1B and FIG. 1C depict a riser 100 that comprises a top riser section 102 and a bottom riser section 104. The top riser section 104 and the bottom riser section 104 define a first plane 108. Bow limbs (see FIG. 6) may be attached to the top riser section 102 and the bottom riser section 104, respectively. An arrow shelf 106 is provided by a middle riser section 110 that defines a second plane 112. The first plane 108 and the second plane 112 are separated by a gap. The middle riser section 110 joins with the bottom riser section 104 at a bottom step 114. The middle riser section 110 joins with the top riser section 102 at a top step 116. A handle 118 is provided below the arrow shelf 106 for an archery to grip the riser 100. During use, the top riser section 102 experiences stresses that causes undesirable deformations. To compensate for such deformations, the riser section 102 may be formed from strong, heavy materials. Unfortunately, this increases both the cost and the weight of the riser 100.

Figure 2A:
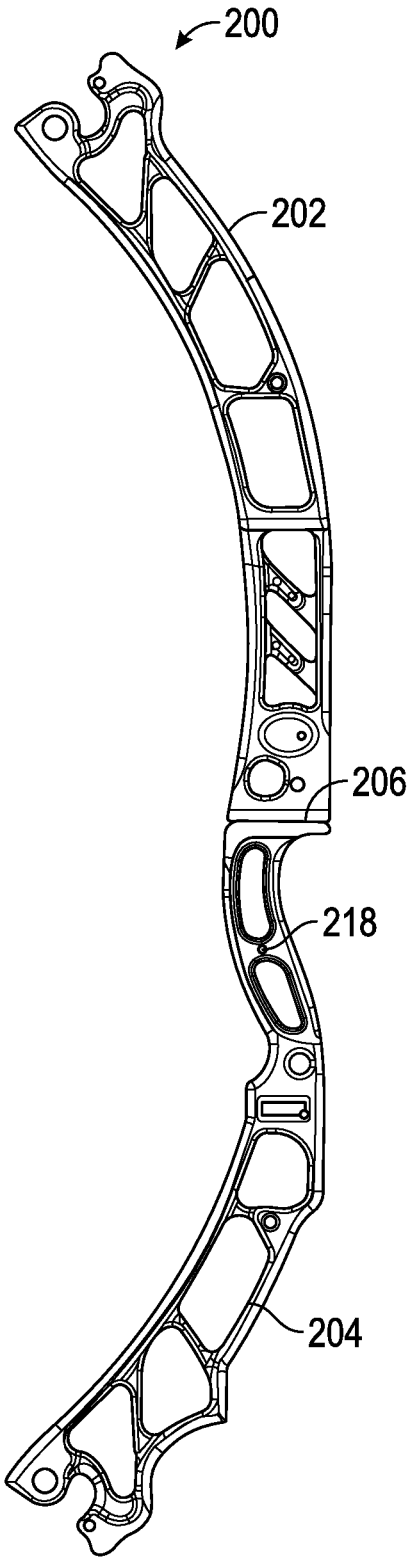
FIG. 2A, FIG. 2B and FIG. 2C are side, front and perspective views of another exemplary riser that includes a second step.
Figure 2B:
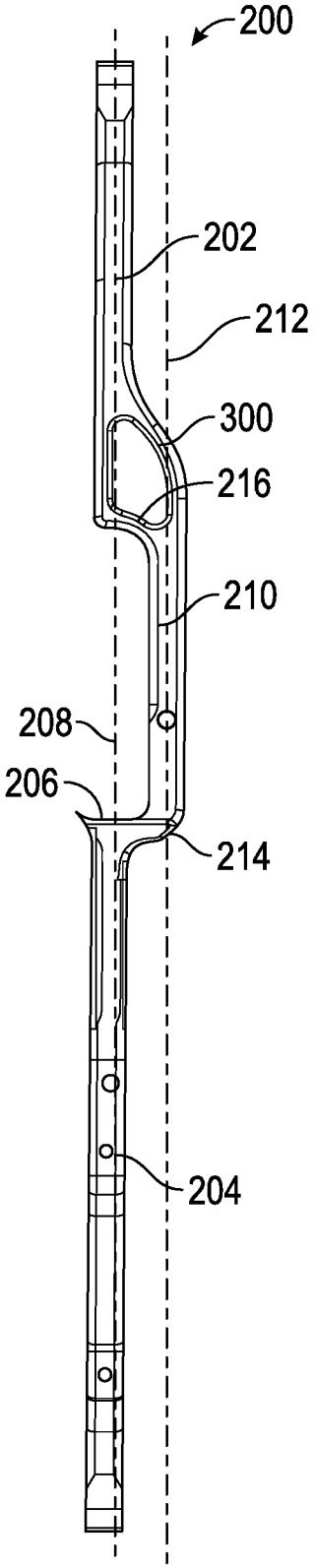
Figure 2C:
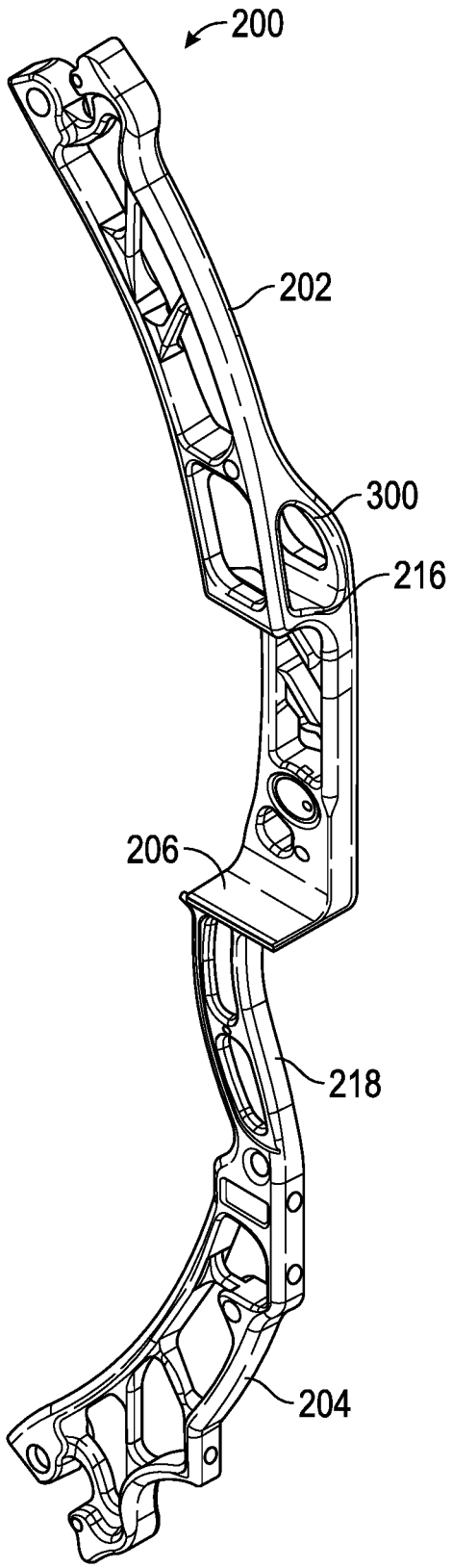

FIG. 2A, FIG. 2B and FIG. 2C depict a riser 200 that comprises a top riser section 202 and a bottom riser section 204. The top riser section 204 and the bottom riser section 204 define a first plane 208. An arrow shelf 206 is provided by a middle riser section 210 that defines a second plane 212. The first plane 208 and the second plane 212 are separated by a gap. The middle riser section 210 joins with the bottom riser section 204 at a bottom step 214. The middle riser section 110 joins with the top riser section 202 at a first top step 216. A handle 218 is provided below the arrow shelf 206 for an archer to grip the riser 200. Unlike the riser 100, the riser 200 further comprises a second top step 300. The configuration shown in FIG. 2A, FIG. 2B and FIG. 2C improves riser strength by as much as 30% and reduces deformation by as much as 20% compared to a riser without such a second top step 300. Due to the increased strength provided by the second top step 300, the riser may be formed using less material. This reduces the weight and cost of the riser without negatively impacting its performance.

Figure 3:
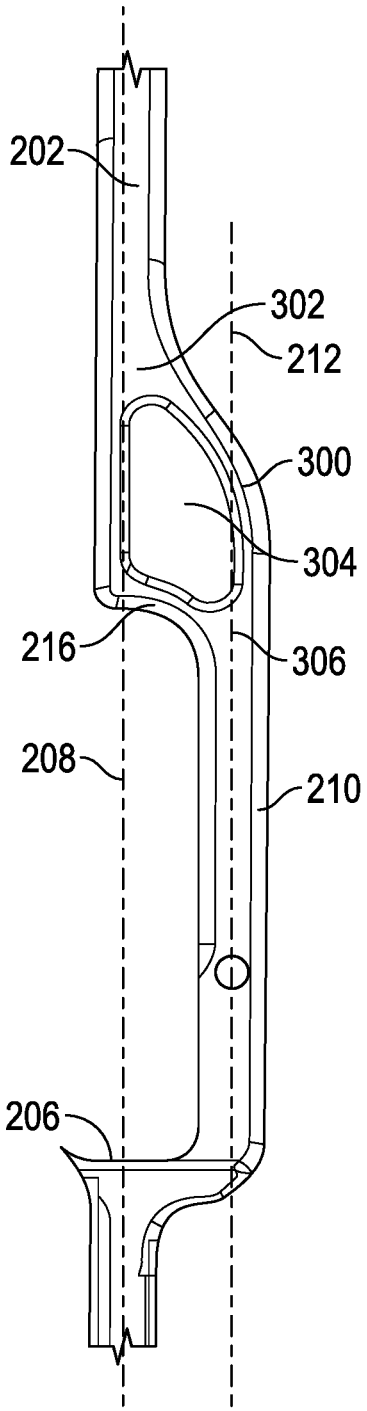
FIG. 3 is an expanded view of a section of the riser of FIG. 2B.

As shown in FIG. 3, the first top step 216 and the second top step 300 join at a first junction 302 where they both contact the top riser section 202. The first top step 216 and the second top step 300 separate to form a cavity 304 and then reunite at a second junction 306 where they both contact the middle riser section 210. The cavity 304 and the second top step 300 provide additional strength to the riser 200 while minimizing the amount of material used. This results in a reduction in weight and manufacturing costs. The first junction 302 is in the first plane 208 while the second junction 306 is in the second plane 212. The first top step 216 is disposed below the second top step 300.

Figure 4:
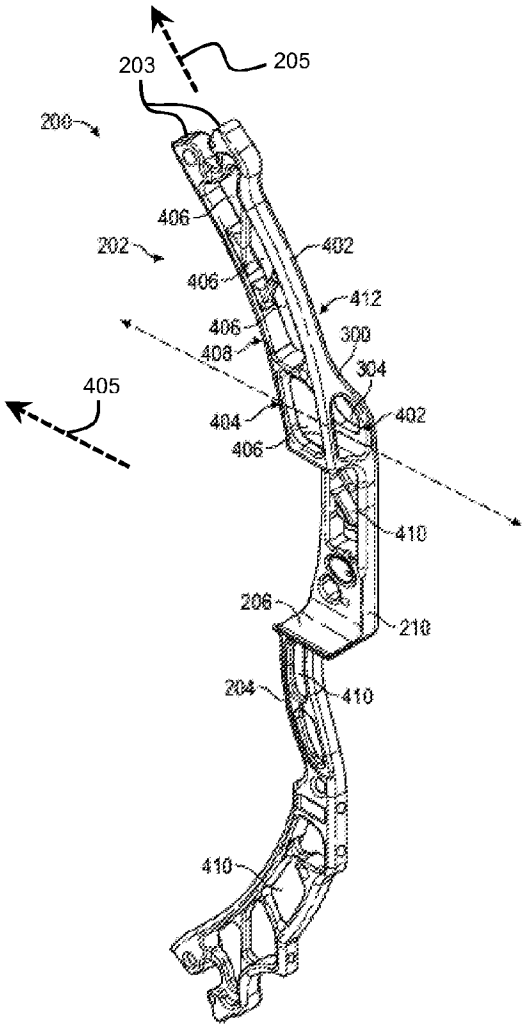
FIG. 4 is an expanded view of the riser of FIG. 2C.

As shown in FIG. 4, the cavity 304 comprises a forward-facing opening 402 (facing in a forward direction 405) and a backward-facing opening 404 that define a direction 404 that is parallel to a plane defined by the arrow shelf 206. The top riser section 202 comprises a limb mount surface 203 (facing in a riser direction 205) and a plurality of holes 406 that extend from a first lateral side 408 to a second lateral side 412. The plurality of holes 406 are perpendicular to the forward-facing opening 402 and the backward-facing opening 404. The presence of the plurality of holes 406 permits the riser 200 to be formed using less materials, thereby reducing the weight and cost of the riser 200. The presence of the shoulder or second top step 300 increases the strength of the riser 200 to minimize undesired deformation. Additional holes 410 in the lower riser section 204 and the middle riser section 210 further reduce the weight and cost of the riser 200. In the embodiment of FIG. 4, the cavity 304 comprises four openings: the forward-facing opening 402, the backward-facing opening 404, and two openings facing the lateral sides 408, 412, respectively. In another embodiment, not shown, the cavity 304 comprises at least one lateral facing opening and the forward-facing and backward-facing sides are solid plates.

Figure 5:
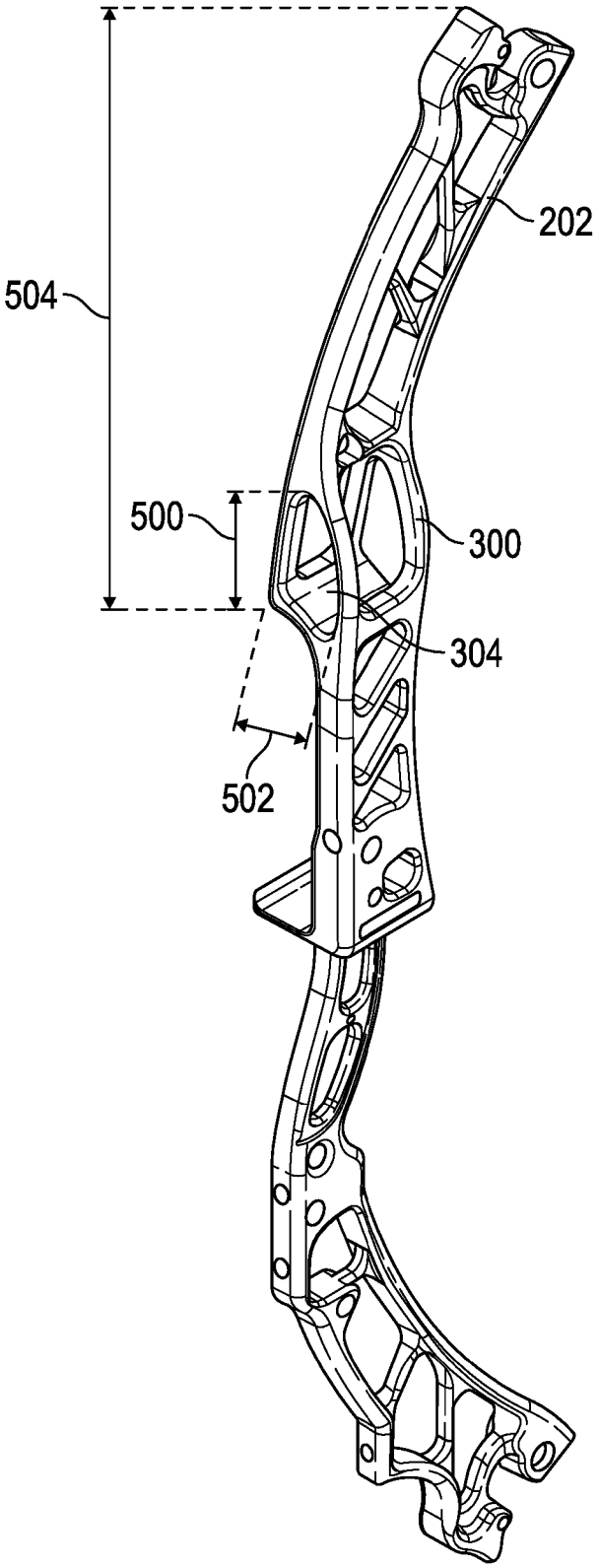
FIG. 5 is another view of the riser of FIG. 4.

As shown in FIG. 5, the cavity 304 has a length 500 and a width 502. In one embodiment, the length 500 is at least about 10% of an overall length 504 of the top riser section 202. In another embodiment, the length 500 is at least about 15% of the overall length 504. In another embodiment, the length 500 is at least about 20% of the overall length 504. In yet another embodiment, the length 500 is about 25% of the over length 504. The width 502 is less than the length 500. In one embodiment, the width is about 50% of the length 500.

Figure 6:
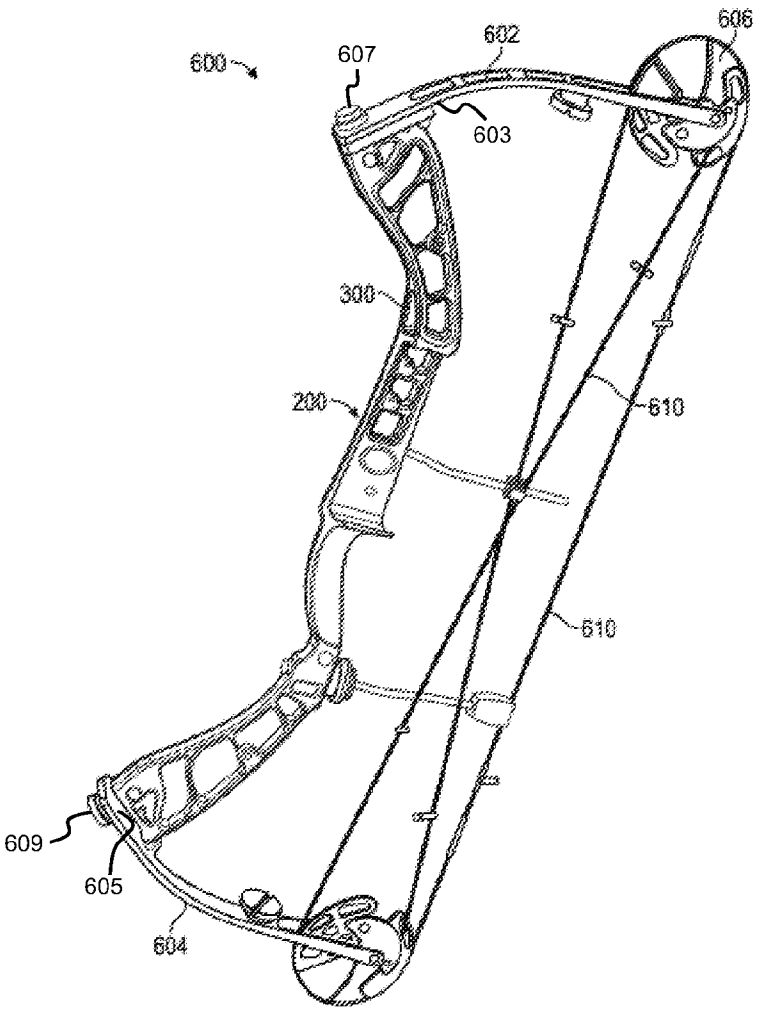
FIG. 6 is a view of an exemplary bow that uses the riser of FIG. 4.

FIG. 6 depicts a compound bow 600 that comprises the riser 200, a first bow limb 602 (having a riser engagement surface 603), a second bow limb 604 (having a riser engagement surface 605), and a plurality of fasteners 607 and 609 that couple the limbs 602 and 604, respectively, to the riser 200. A first cam 606 and a second cam 608 are attached to the first bow limb 602 and the second bow limb 604, respectively. Bowstrings 610 are stretched between the first cam 606 and the second cam 608. When the bowstrings 610 are actuated, the first bow limb 602 and the second bow limb 604 bend and apply a strain to the riser 200. The second top step 300 (see FIG. 3) minimizes the deformation in the riser 200 caused by the strain. The presence of cams in the compound 600 permits a bowstring to be drawn with high force which results in significant strain on the riser 200. Accordingly, the riser 200 is particularly useful with compound bows.

In one embodiment, the riser is monolithic such that the top riser section, the bottom riser section and the middle riser section are formed as a single piece. The riser may be formed from a lightweight material, such as aluminum.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The following is claimed:

1. A bow riser comprising:

an upper section comprising:

an upper section front configured to at least partially face in a forward direction toward a shooting target;

an upper section back configured to at least partially face in a backward direction away from the shooting target;

a plurality of upper section sides; and a limb mount surface comprising a first segment centrally located between the upper section sides, the first segment being located in a first vertical plane when the bow riser is vertically positioned;

a structure connected to the upper riser section, the structure defining an interior space comprising a space center, the structure comprising:

a first structure side extending in a first side plane, the first side plane being offset from the space center; and a second structure side extending in a second side plane, the second side plane also being offset from the space center;

a middle section extending from the structure, the middle section comprising:

a middle section front configured to at least partially face in the forward direction;

a middle section back configured to at least partially face in the backward direction;

a plurality of middle section sides; and a second segment centrally located between the middle section sides, the second segment being located in a second vertical plane, the second vertical plane being offset from the space center, the second vertical plane also being offset from the first vertical plane;

a handle section extending from the middle section; and a lower section extending from the handle section.

2. The bow riser of claim 1, wherein the limb mount surface is positioned outside of the interior space.

3. The bow riser of claim 1, wherein the structure comprises a step, the step configured to extend horizontally to cause the space center to be offset from the second vertical plane.

4. The bow riser of claim 1, wherein the structure comprises a shoulder, the shoulder configured to extend horizontally to cause the space center to be offset from the second vertical plane.

5. The bow riser of claim 1, wherein:

the limb mount surface of the upper section is configured to be coupled to a limb;

the limb is configured to be coupled to a bowstring operable to transmit a bowstring force to the limb;

at least part of the bowstring force acts along the first segment in the first vertical plane;

the handle section is configured to receive a holding force from a user;

at least part of the holding force acts along the second segment in the second vertical plane; and the first and second structure sides are configured to distribute the at least part of the bowstring force and the at least part of the holding force so as to reduce deformation of the upper section.

6. The bow riser of claim 1, wherein the middle section comprises an arrow shelf.

7. The bow riser of claim 1, wherein:

the upper section is rigid;

the limb mount surface is configured to engage a riser engagement surface of a limb;

the limb is configured to flex between a plurality of positions in response to a bowstring force;

the limb mount surface is configured to: (a) receive a portion of the bowstring force transmitted from the riser engagement surface; and (b) exert a reactionary force on the riser engagement surface; and the bow riser comprises a fastener configured to keep the riser engagement surface coupled to the limb mount surface while the limb is subject to the bowstring force.

8. The bow riser of claim 1, wherein the structure comprises a cage shape, and the interior space is unoccupied by any insertable component so as to avoid increasing a weight of the structure.

9. The bow riser of claim 1, wherein each one of the first and second structure sides defines an opening, each opening providing access to the interior space.

10. The bow riser of claim 1, wherein:

the structure defines a structure front defining a front opening; a structure back defining a back opening, the front and back openings being positioned on an axis parallel to the forward direction when the bow riser is vertically positioned; and the front and back openings are configured to enable visibility to the shooting target when the bow riser is vertically positioned.

11. An archery bow comprising the bow riser of claim 1 and a plurality of limbs coupled to the bow riser, wherein at least the upper section is rigid, at least one of the limbs is configured to flex between a plurality of positions in response to a bowstring force applied to the at least one limb, the at least one limb comprises a riser engagement surface engaged with the limb mount surface, and the archery bow comprises at least one fastener configured to couple the at least one limb to the limb mount surface.

12. The bow riser of claim 1, wherein the middle section comprises a thickness extending from one of the middle section sides to another one of the middle section sides, the structure comprising a dimension extending along an axis that is transverse to a plane in which the forward direction extends when the bow riser is vertically positioned, the dimension being greater than the thickness of the middle section so as to reduce deformation of the upper section.

13. The bow riser of claim 1, wherein the bow riser has an at least partial arc shape, wherein the limb mount surface faces in a riser direction, wherein the riser direction is directed at least partially in the forward direction.

14. A riser for an archery bow, the riser comprising:

a first section configured to be coupled to a first limb, the first section comprising:

a limb mount surface comprising a section center, wherein, when the riser is vertically positioned: (a) the section center is centrally located on the first section relative to a horizontal axis extending through the first section; (b) the section center is located on a vertical axis; and a structure being at least partially hollowed to bound an interior cavity comprising a cavity center, the structure comprising: (a) a structure front configured to at least partially face a shooting target; (b) a structure rear; (c) a first structure side extending in a first plane, the first plane being offset from the cavity center; (d) a second structure side; and (e) a first dimension extending from the first structure side to the second structure side; and a second section comprising: (a) a first end connected to the first section; (b) a second end; (c) a front configured to at least partially face the shooting target; (d) a rear; (f) a plurality of section sides; and (g) a second dimension extending from one of the section sides to another one of the section sides, the second dimension being less than the first dimension of the first section;

a third section extending downward from the second end when the riser is vertically positioned, the third section comprising a handle; and a fourth section extending downward from the third section, the fourth section configured to be coupled to a second limb, wherein the first dimension of the structure is configured to reduce deformation of the first section, wherein the hollowing of the structure reduces an effect of any weight increase caused by the first dimension of the structure.

15. The riser of claim 14, wherein the structure comprises a step, the step comprising the first dimension, the step being configured to extend horizontally to cause the interior cavity to be offset from at least one of the first and second planes.

16. The riser of claim 14, wherein the limb mount surface is located outside of the interior cavity.

17. The riser of claim 14, wherein the second section comprises an arrow shelf.

18. A bow riser comprising:

an upper section comprising a limb mount surface configured to be coupled to an upper limb, the upper section comprising a structure defining a cavity, the cavity comprising a center, the structure comprising: (a) a first side lying in a first side plane; (b) a second side lying in a second side plane; and (c) a transition step connecting the first side to the second side, the transition step extending from a position on the first side in a direction away from the first side plane;

an L-shaped section extending downward from the transition step, the L-shaped section comprising: (a) an upright portion extending upward in an upright plane to the position of the transition step; and (b) an arrow support extending in the direction, the arrow support configured to support an arrow before the arrow is launched; and a handle section extending downward from the arrow support, wherein the center of the structure is offset from the upright plane, wherein the structure is configured to decrease deformation of the upper section when the upper section is subject to a portion of a bowstring force received from the upper limb, wherein the limb mount surface is located outside of the cavity.

19. The bow riser of claim 18, wherein the upper section comprises a plurality of section sides and a section center located midway between the section sides, the section center being offset from the upright plane.

20. The bow riser of claim 18, wherein:

the limb mount surface is configured to engage a riser engagement surface of the limb;

the limb mount surface is configured to: (a) receive a force from the riser engagement surface; and (b) exert a reactionary force on the riser engagement surface; and the bow riser comprises a fastener configured to keep the riser engagement surface coupled to the limb mount surface while the limb is flexed and moved relative to upper section.

21. The bow riser of claim 18, wherein each of the first and second sides defines an opening providing access to the cavity.

* * * * *